United States Patent [19]

Durinck

[11] 4,119,692

[45] Oct. 10, 1978

[54] PROCESS AND APPARATUS FOR MANUFACTURING CARBON ELECTRODES

[75] Inventor: René Durinck, Villeneuve d'Ascq, France

[73] Assignee: Fives-Cail Babcock, Paris, France

[21] Appl. No.: 767,490

[22] Filed: Feb. 10, 1977

Related U.S. Application Data

[63] Continuation-in-part of Ser. No. 644,876, Dec. 29, 1975, abandoned.

[30] Foreign Application Priority Data

Dec. 31, 1974 [FR] France ..... 74 43372

[51] Int. Cl.[2] ..... B28B 1/10

[52] U.S. Cl. ..... 264/71; 264/109; 425/421; 425/432

[58] Field of Search ..... 264/71, 109; 425/421, 425/432, 456

[56] References Cited

U.S. PATENT DOCUMENTS

| | | | |
|---|---|---|---|
| 2,353,492 | 7/1944 | O'Connor | 425/432 |
| 2,407,168 | 9/1946 | Lindkvist | 425/456 |
| 3,743,468 | 7/1973 | Helmrich et al. | 425/421 |

*Primary Examiner*—Francis S. Husar
*Assistant Examiner*—John McQuade
*Attorney, Agent, or Firm*—Kurt Kelman

[57] ABSTRACT

Carbon electrodes are manufactured in a mold which is integral with a vibrating table and whose open top is closed by a cover resting on a pasty mass in the mold. The vibrating assembly consisting of the table, mold and mass is subjected to a frequency of vibrations which is 1.1 to 1.6 times the frequency of natural vibrations of the assembly and the cover preferably applies a static pressure of about 0.5 bars on the mass.

5 Claims, 2 Drawing Figures

PROCESS AND APPARATUS FOR MANUFACTURING CARBON ELECTRODES

This is a continuation-in-part of my copending application Ser. No. 644,876, filed Dec. 29, 1975, now abandoned.

The present invention relates to improvements in a process of, and apparatus for, manufacturing carbon electrodes from a pasty mass which is compacted by vibrations in a mold of suitable configuration.

Apparatus of this type comprises a vibrating table, a mold affixed to the table, the mold having an open top enabling the pasty mass to be introduced into the mold, and a heavy plate constituting a cover which is mounted from above on the open top, after the mold has been filled with the pasty mass, to rest thereon while the mass is being compacted.

If carbon electrodes of large dimensions are to be manufactured, such as anodes utilized in the production of aluminum by electrolysis, considerable vibrating forces must be applied to the vibrating assembly consisting of the table, the mold and the mass to obtain electrodes of the desired density. Such forces create high stresses on certain elements, particularly the springs on which the table vibrates and the bearings of the imbalanced shafts used to impart vibration to the table.

It is the primary object of this invention to increase the life of such an apparatus and, more particularly, those elements thereof subjected to excessive wear by high vibratory forces, and correspondingly to decrease the cost of maintaining the apparatus by a selection of operating parameters permitting a reduction in the forces of vibration.

This and other objects, are accomplished in accordance with the process of the invention by applying to the table vibrations of a frequency which is 1.1 to 1.6 times the frequency of the natural vibrations of the vibrating assembly and, preferably, applying a static pressure of about 0.5 bars on the mass through the cover.

In the molding apparatus of the present invention, the ratio of the mass of the cover to that of the total mass of the vibrating assembly is between 0.25 and 0.65, the frequency of the natural vibrations of the vibrating assembly being between 12 and 17 Hz. The natural vibration of a vibrating assembly is the vibration at which such an assembly continues to vibrate freely and without applying an outside force to it after it has been brought to vibration. The frequency of this natural vibration is solely a function of the mass and the stiffness of the resilient or elastic elements supporting it.

Figure 2:
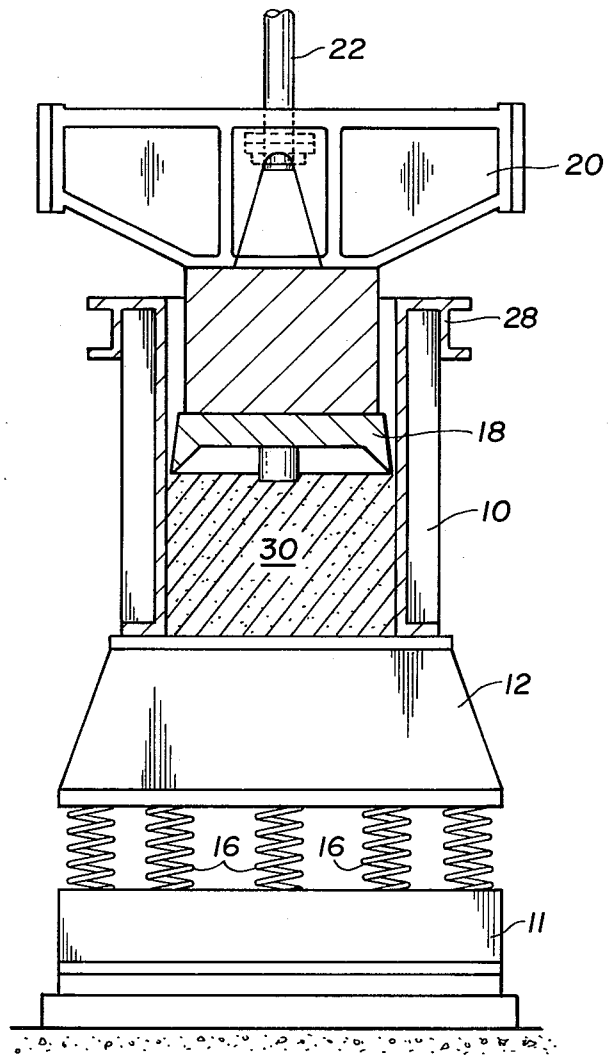
Figure 1:
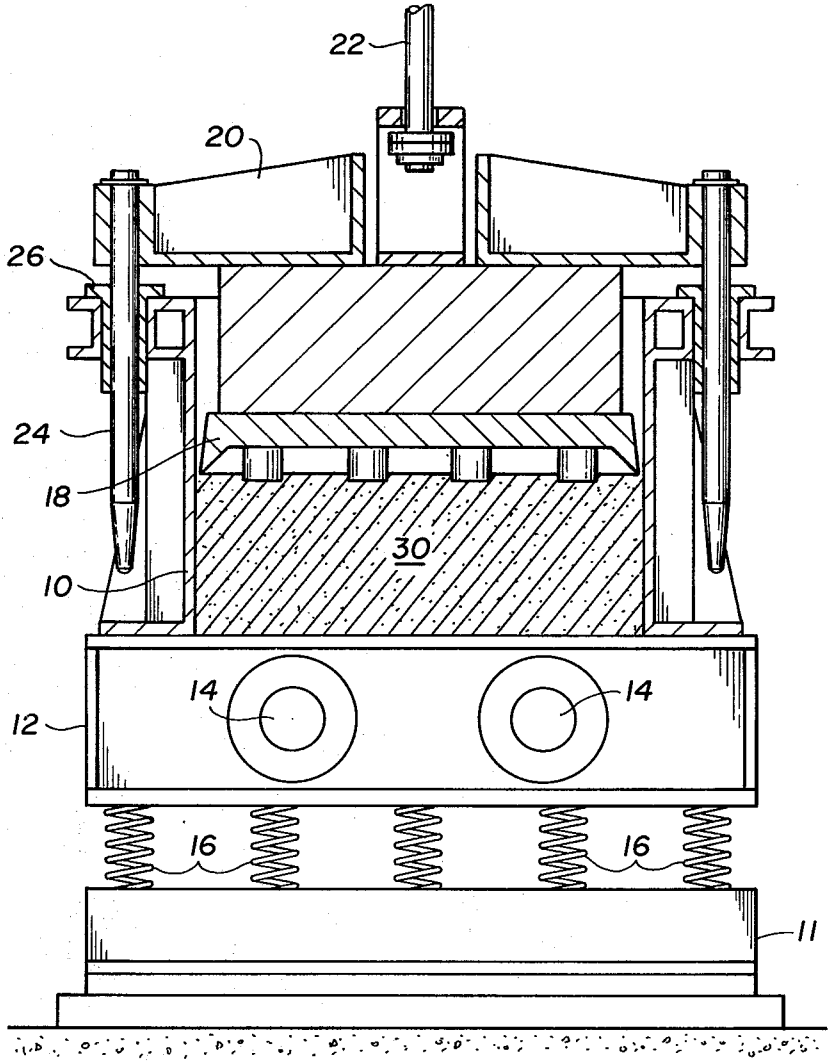

The above and other objects, advantages and features of this invention will become more apparent from the following detailed description of a now preferred embodiment thereof, taken in conjunction with the accompanying drawing wherein FIG. 1 is a side elevational view of the apparatus, partly in section, and FIG. 2 is an end view of the apparatus, partly in section.

Referring now to the drawing, there is shown an open-top mold 10 of rectangular cross section, affixed to vibrating table 12 to form an integral unit therewith. A series of compression springs 16 support the table resiliently on base 11, and two imbalanced shafts 14, 14 are journaled in the table, rotation of the imbalanced shafts causing the table and the mold affixed thereto to vibrate at the desired frequency.

After a charge of pasty material 30 has been introduced into mold 10, heavy cover plate 18 is lowered into the mold through its open top. The cover plate is rigidly affixed to crossbeam 20 which is fastened to a lifting device by means of connecting rod 22. The connecting rod is linked to the crossbeam with sufficient play to permit the cover plate to hang freely and to prevent the vibrations to which it is subjected from being transmitted to the lifting device and the framework which supports it. The crossbeam has vertical guide rods 24 rigidly affixed thereto and co-operating with guideways 26 carried by frame 28 which is integral with the mold.

In operation, the imbalanced shafts are rotated in opposite directions and at the same rotary speed by suitable drive means (not shown). The rotations of the two shafts are synchronized so that the horizontal components of the forces of vibrations produced thereby are at all times equal and opposed to each other. Nevertheless, parasitic horizontal forces subsist and, to eliminate horizontal vibrations which could damagingly influence the homogeneity of the molded electrodes, the mold is vertically guided in a suitable manner not forming part of the present invention.

During their rotation, the imbalanced shafts subject the assembly consisting of table 12, mold 20 and the charge of pasty mass 30 in the mold to vertical vibrations whose frequency is equal to the speed of rotation of the shafts. The cover plate resting on mass 30 is free to be displaced vertically in the mold and progressively is lowered thereinto as the mass is compacted.

The frequency of vibrations imposed on the vibrating assembly by the rotating imbalanced shafts is between 15 and 20 Hz, and is equal to 1.1 to 1.6 times the frequency of natural vibrations of the assembly, which is preferably between 12 and 17 Hz.

The mass of the cover plate is substantially equal to about half the mass of the vibrating assembly and the pressure exerted thereby on the mass in the mold is about 0.5 bars. By the mass and weight of the cover plate is understood the mass and weight of the assembly resting on mass 30, which is constituted essentially by cover plate 18, crossbeam 20 and the elements connecting the cover plate to the crossbeam.

I claim:

1. A process of manufacturing carbon electrodes from a pasty mass, wherein the pasty mass is placed into a mold having an open top, the mold being integral with a vibrating table and the table, mold and pasty mass constituting a vibrating assembly, maintaining the assembly at a frequency of natural vibrations, and closing the open top of the mold with a cover resting on the pasty mass in the mold, the improvement comprises the step of applying to the table vibrations of a frequency which is 1.1 to 1.6 times the frequency of the natural vibrations.

2. The manufacturing process of claim 1, further comprising the step of applying the cover under a static pressure of about 0.5 bars on the mass.

3. A mold apparatus for manufacturing carbon electrodes from a pasty mass, which comprises a vibrating table, vibrating means for the table, a mold affixed to the table, the mold having an open top, and a cover resting on a charge of the mass in the mold, the ratio of the mass of the cover to that of total mass of the vibrating assembly consisting of the table, the mold and the pasty mass being between 0.25 and 0.65.

4. The molding apparatus of claim 3, wherein the the cover applies a static pressure of about 0.5 bars on the pasty mass.

5. The molding apparatus of claim 3, further comprising a resilient support for the table for maintaining the vibrating assembly at a frequency of natural vibrations between 12 and 17 Hz.

* * * * *